US006283109B1

(12) United States Patent
Wiseby et al.

(10) Patent No.: US 6,283,109 B1
(45) Date of Patent: Sep. 4, 2001

(54) STABILIZERS FOR AN ARCHERY BOW

(76) Inventors: Dennis Wiseby, Box 30, S-512 21 Svenljunga; Tony Wiseby, Ljungaskogatan 4, S-512 93 Svenljunga, both of (SE)

( * ) Notice: Subject to any disclaimer, the term of this patent is extended or adjusted under 35 U.S.C. 154(b) by 0 days.

(21) Appl. No.: 09/269,910

(22) PCT Filed: Oct. 1, 1997

(86) PCT No.: PCT/SE97/01646

§ 371 Date: Mar. 31, 1999

§ 102(e) Date: Mar. 31, 1999

(87) PCT Pub. No.: WO98/14746

PCT Pub. Date: Apr. 9, 1998

(30) Foreign Application Priority Data

Oct. 1, 1906 (SE) ..... 9603578
Jan. 19, 1997 (SE) ..... 9700092

(51) Int. Cl.[7] ..... F41B 5/20
(52) U.S. Cl. ..... 124/89
(58) Field of Search ..... 124/89; 188/378

(56) References Cited

U.S. PATENT DOCUMENTS 3,342,172 * 9/1967 Sanders ..... 124/89 X
3,658,157 4/1972 Lee .
4,706,788 * 11/1987 Inman et al. ..... 188/378
4,893,606 1/1990 Sisko ..... 124/89
5,016,602 5/1991 Mizek ..... 124/89
5,339,793 8/1994 Findley ..... 124/89
5,388,563 2/1995 Hsu ..... 124/89 X
5,595,168 * 1/1997 Martin ..... 124/89
5,595,169 1/1997 Brown, Jr. ..... 124/89
5,735,257 * 4/1998 Walk ..... 124/89
5,975,070 * 11/1999 Sands ..... 124/89

FOREIGN PATENT DOCUMENTS 1296201 11/1972 (GB) .

* cited by examiner

*Primary Examiner*—John A. Ricci
(74) *Attorney, Agent, or Firm*—Orum & Roth

(57) ABSTRACT

The invention relates to a stabilizer for an archery bow, a crossbow or similar weapon where vibrations occur, and which is formed by a housing which is provided with a coupling at one of its ends in order to enable releasable interconnection of the stabilizer and the weapon, and that a material is received in the interior of the housing which material consists of foam plastic with a damper body contained therein conisistinig of metal, for example lead or other material, which presents a larger density than the foam plastic. According to the invention, several balls or similar small damper bodies are contained in and attached to the foam plastic material, which consists of an inertia elastic polyurethane foam plastic with open cells.

21 Claims, 5 Drawing Sheets

STABILIZERS FOR AN ARCHERY BOW

BACKGROUND OF THE INVENTION

1. Field of the Invention

The present invention relates to a stabilizer for an archery bow, a crossbow or similar weapon where vibrations occur in use, and which is formed by housing which is provided with a coupling at one of its ends in order to enable releasable interconnection of the stabilizer and the weapon. A material is received in the interior of the housing which material consists of foam plastic with a damper body contained therein consisting of material, for example lead or other material, which presents a larger density then foam plastic.

2. Description of Related Art

Stabilizers for archery bows are know which are intended to be used for the purpose of competition and hunting, i.e. so called 3-D archery bows. Prior art stabilizers are formed by tubes filled with damping means consisting of oil or other suitable hydraulic fluid or mercury, or consisting of tubes with mill-out patterns. The ability to provide stability varies for those bows used in cooperation with these prior art stabilizers.

U.S. Pat. No. 5,339,793 shows a stabilizer for archery bows and which comprises a hosing with a metal damper rod inside which is embedded in foam plastic material. However, the damper rod which extends along a substantial part of the housing, has during testing not fulfilled expectations of damping efficiency. A contributing reason for this is that the damper rod, because of its weight, compresses the pliant foam plastic material at the bottom of the damper rod. The fact is that the gam plastic material of said known stabilizers is very easy to compress because its density is very small. Also, the longitudinal damper rod is received loosely within the foam plastic material body in the housing, but may be held fixed by means of a clamp ring at its respective end.

BRIEF SUMMARY OF THE INVENTION

The main object of the present invention is therefore in the first hand to solve said problem with simple and effective functioning means, and to provide a stabilizer which serves to dampen vibrations and disturbing movements in all directions.

This object is achieved by means of a stabilizer according to the present invention which principally is characterized in that several balls or similar small damper bodies are contained in and attached to the foam plastic material, which consists of an inertia elastic polyurethane foam plastic with open cells.

Another object of the invention is to provide a stabilizer of the above described kind which also is compact.

This further object of the invention is achieved by means of a stabilizer according to the present invention which principally is characterized in that several balls or similar smaller damper bodies are received as a damper body in a common layer among a common plane between a number of foam plastic bodies received in the housing and being attached to the foam plastic material, which consists of an inertia elastic polyurethane foam plastic with open cells.

The invention will be described here below as a number of preferred embodiments, whereby is referred to the accompanying drawings.

DETAILED DESCRIPTION OF THE INVENTION

Figure 1:
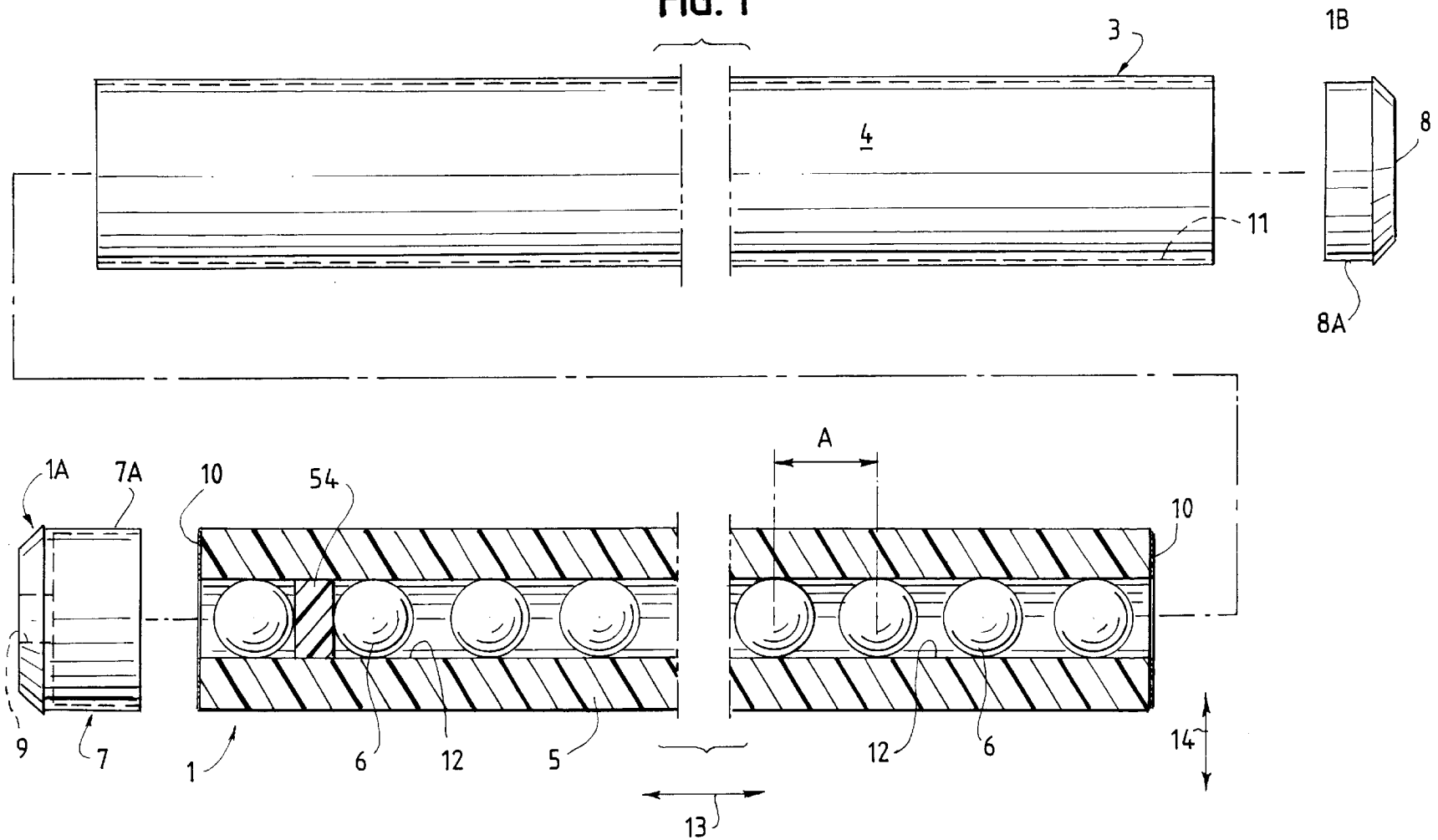
FIG. 1 shows an explode view of a stabilizer.

A stabilizer 1; 201 in accordance with the present invention and which at first hand is intended for use on an archery bow 2, for the purpose of competition and hunting, i.e. both for target shooting as well as other kinds of competition, and also for the purpose of hunting, i.e. so called 3-D shooting, but which is also suitable for crossbows or similar weapons where vibration occurs. The stabilizer includes a housing 3; 203 which is provided with a coupling 9; 209 at one of its ends 1A; 201A in order to enable releasable interconnection of the stabilizer from the weapon 2.

A damper material 5; 205 is received in an aperture 4; 204 within the housing 3 which material comprises an inertia elastic polyurethane foam plastic with open cells. Said foam plastic is available from Fagerdala Industri AB on Värmdö under the name T-foam (Temper Foam) or Tempur® respectively and is a foam plastic material having a volumetric weight of for example 85 kg/m$^3$ TD 85 and is used for mattresses and pillows. The materials may easily be compressed when it is subjected to a load with even distribution of the force, and the material returns rapidly to its original shape when the load is removed.

A number of balls or similar smaller damper bodies 6; 206 presenting a larger density than said foam plastic material 5; 205, are thereby received in it, i.e. in the inertia elastic polyurethane foam plastic material 5; 205 which in turn is contained in the housing 3; 203. Said ball shaped damper bodies 6; 206 may for example consist of metal, for example lead, glass or other suitable material with similar density and which presents the desired qualities.

According to one embodiment of the invention, said housing 3 preferably consists of metal, like e.g. aluminum or other light material such as plastic material, glass fiber or other fiber material, or a composite material, and is preferably tube-shaped. Gables 7, 8 in the shape of sleeves having a part 7A, 8A which may be inserted into said housing 3, consisting of metal, e.g. aluminum or other suitable strong material, and are thereby connected to the housing 3 with the therein enclosed foam plastic material 5. Such a coupling 9 for detachable attachment of the stabilizer to a weapon 2 may be arranged in one of the gable sleeves 7, for example in the shape of a threaded hole or a protruding threaded rod, wherein a correspondingly fitting threaded part or threaded hole, respectively, is provide on the weapon 2 at desired location/locations where it is desirable to attach the stabilizer 1. The above described foam plastic material 5 is connected to the housing 3 internally in it. For example, it may be attached by means of adhesive means 10, like for example glue with the front or the back part respectively of the housing, e.g. the gables 7, 8, but the foam plastic material 5 may also or alternatively be attached with adhesive means 10, with the internal envelope surface 11 of the housing.

A necessary number of damper bodies 6 are received internally within said foam plastic material 5, according to the above "described", inside a fitting cavity 12. The damper bodies 6, are received in a cavity 12 extending centrally along the longitudinal axis 13 of the housing in the foam plastic material 5 spaced apart distance A from each other, and attached by glue to the envelope surface of the centrally located cavity 12. The damper bodies 6 are influenced by vibrations and thrusts from the weapon to compress the foam plastic material 5 both in the longitudinal direction 13 as well as in the transverse direction 14. The positions of the damper bodies 6 in the foam plastic material 5 may vary according to need as well as to the number of damper bodies 6 in order to render the archery bow 2 with the right distribution of weight. According to one preferred embodiment of a stabilizer 1 are several damper bodies 6, or similar balls or bodies arranged at mutual distances A from each other in a common cavity 12.

The above-mentioned damper bodies 6, are received in the foam plastic material 5 rigidly attached to the foam plastic material 5. The above-mentioned damper bodies 6 are attached by glue to the foam plastic material 5 by means of for example siprox film glue received centrally along the longitudinal axis 13 of the housing extending cavity 12, $12^1$, in the foam plastic body 5 at longitudinal distances A from each other as seen in the longitudinal extension of the stabilizer, i.e. the longitudinal extension 13 of the foam plastic body and the housing. More exactly, the balls 6 are attached by glue in the interior of a through cavity 12, of the foam plastic body 5.

Preferably, the foam plastic body 5 is tubular with a slit 51 extending along the entire envelope 52 of the body from the outside and into the central cavity 12. Because of this, the foam plastic body may be split open along said slit 51 for application and attaching damper body balls 6 by internal gluing.

Pieces 54 of material may be placed between the damper body balls 6, said material also consisting of inertia elastic polyurethane foam with open cells.

Figure 2:
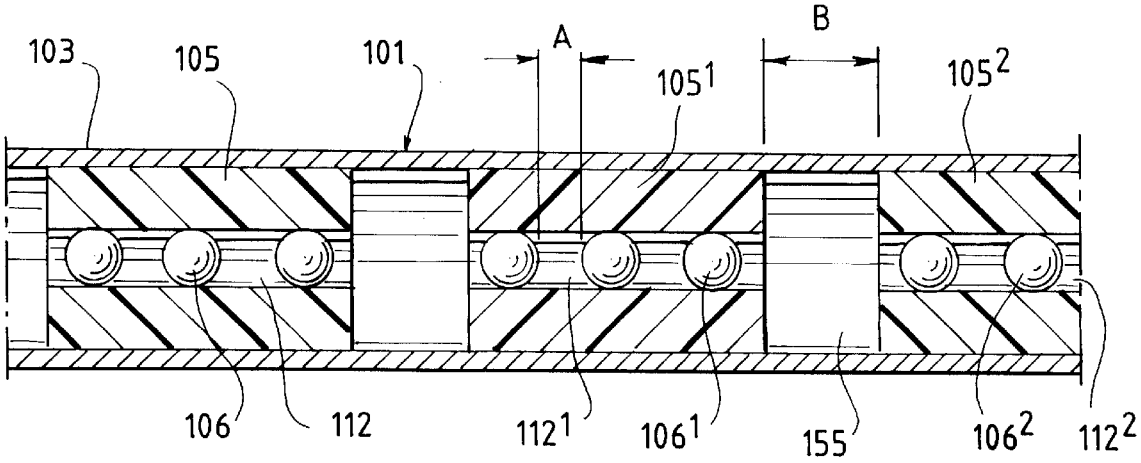
FIG. 2 shows a sectional view of a stabilizer.
Figure 3:
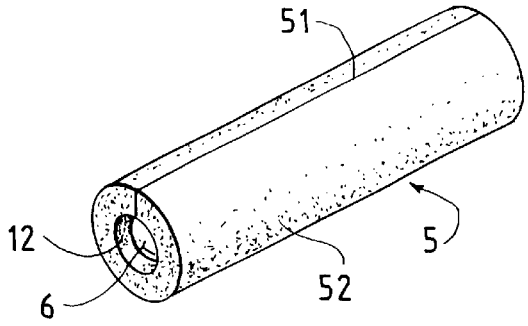
FIG. 3 shows a perspective view of a foam plastic tube for a stabilizer.

As is shown in FIG. 2, several foam plastic bodies 105, $105^1$, $105^2$ with appurtenant damper body balls 106–$106^2$ are included in the stabilizer 101 inside a central channel 112, $112^1$, $112^2$, glued together with each other either, close together or at distances B from each other, forming space 155 between them, and attached by glue to the housing 103.

The above described foam plastic body 5 or bodies 105–$105^2$ respectively, consist of material which presents a density of about 85 kg/$m^3$. Also, further outer coupling devices may be arranged on the stabilizer 1 at its outer end 1B for enabling attachment of damper weights, if so wished, in order to further enhance the damping and stabilizing ability of the stabilizer 1 on the weapon 2.

The stabilizer 1, 101 according to the present invention is thus enabled to efficiently provide advantageous conditions to the archer without interfering trembling, recoil and other force affecting, aggravating conditions which impair the ability to shoot.

Figure 4:
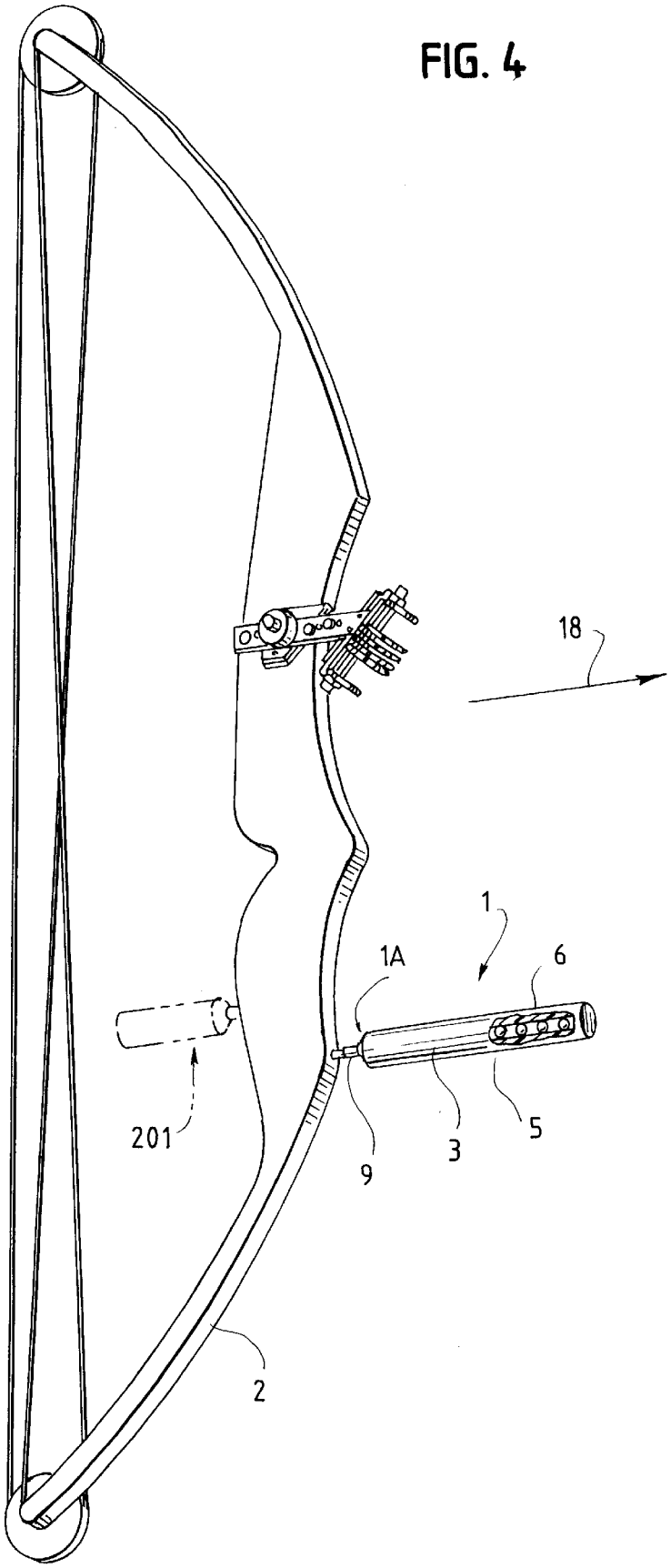
FIG. 4 shows mounted stabilizers on an archery bow.
Figure 5:
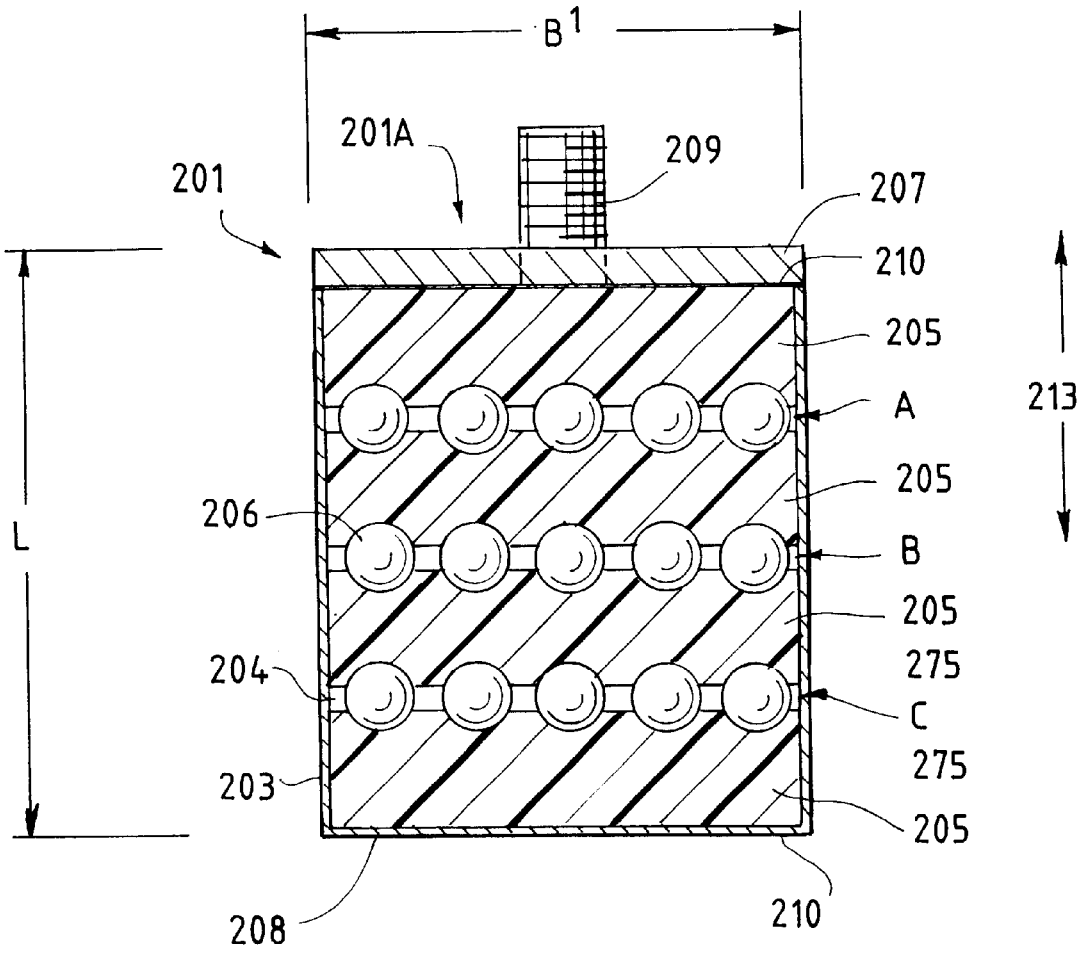
FIG. 5 shows a longitudinal sectional view of another stabilizer embodiment of the present invention.
Figure 6:
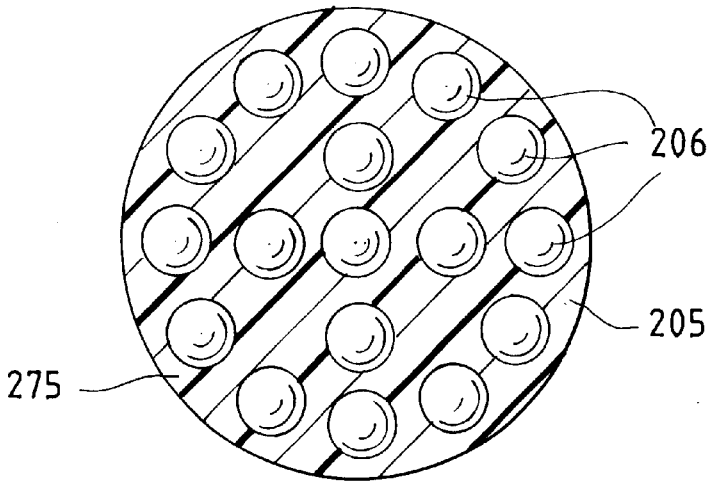
FIG. 6 shows a sectional view of the stabilizer embodiment of FIG. 5.
Figure 7:
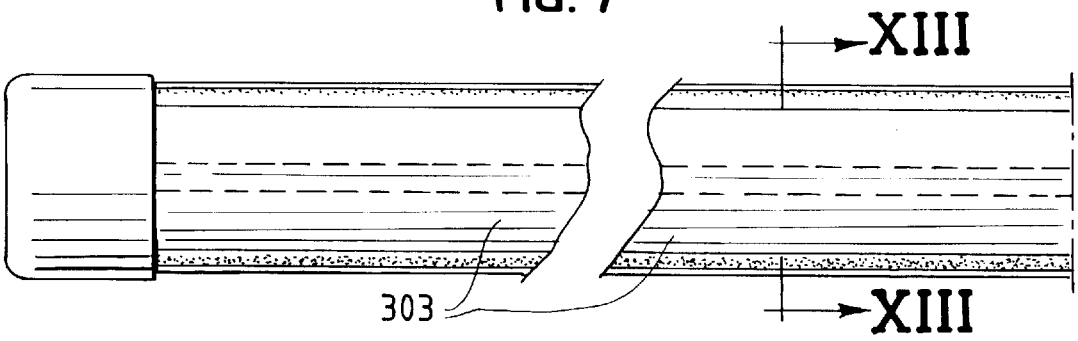
FIG. 7 shows a side view of the housing.
Figure 8:
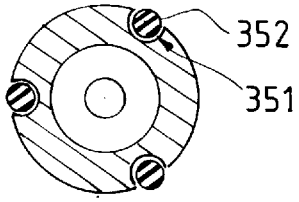
FIG. 8 shows a sectional view of the housing along the line VIII—VIII in FIG. 7.

In FIG. 4 is shown a mounted stabilizer 1 protruding in the direction 18 of shooting an archery bow, and a shorter mounted stabilizer 201 marked with broken lines shown pointing backward, i.e. pointing away from the archery bow 1 against the direction 18 of shooting. Other designs than straight may also occur for the stabilizer, for example Y-shaped, and several stabilizers 1 may be linked together to cooperate with each other, for example projecting from a common attachment on the bow 2, for example diverging like a V.

According to the second embodiment of the damper the aforementioned housing 203 preferably is composed of metal, like for example aluminum or other light material e.g. plastic material, glass fiber or other fiber material, composite material and is preferably designed as a tube with gables. An aforementioned coupling 209 for detachable attachment of the stabilizer to a weapon may be arranged in one of the gable sleeves 207, for example in the shape of a threaded hole or a projecting threaded rod, wherein a corresponding fitting threaded member or threaded hole respectively, is located on the weapon on the desirable to support the stabilizer 201 in question. The aforementioned foam plastic material 205 is connected to the housing 203 internally. For example, it may be attached by adhesive means 210, like for example glue to the front or the rear part of the housing e.g. the gables 207, 208.

Internally in said foam plastic material 205 is received the necessary number of damper bodies 206, according to above. The aforementioned damper bodies 206, are received in a common layer A, B, C, within a common plane between a number of foam plastic bodies 205 that are received in the housing 203. The aforementioned damper bodies 206 are influenced by vibrations and recoils from the weapon to compress the foam plastic material 205 both in the longitudinal direction 213 as well as in the transverse direction 214. The position and number of damper bodies 206 within the foam plastic material 205 may be varied according to need, to render the archery bow the right weight distribution. According to the preferred design of a stabilizer 201, the received damper bodies 206 are arranged to be formed by balls or similar bodies which are distributed along and are attached to each other adjoining surfaces 275 of conjugate disc shaped foam plastic bodies 205.

The aforementioned damper bodies 206, are received in the foam plastic material 205 attached by means of glue to the foam plastic material 205 for example siprox film glue. The damper bodies 205 are attached by glue to a shape adapted preformed holed or even surface 275 of said foam plastic bodies 205. The damper bodies 206 may be evenly distributed along the circumference of a foam plastic body 205 and also in the space between them in the middle of the foam plastic bodies.

The aforementioned foam plastic bodies 205 consist of material which exhibits a density of about 85 kg/$m^3$. Furthermore, additional external coupling means may be arranged on the stabilizer at its outer end in order to enable attachment of damper weights, if this is desirable, in order to further improve the damping and stabilizing ability of the stabilizer 201 on the weapon.

Thus, by means of a stabilizer 201 in accordance with the present invention, is thus enabled to efficiently provide advantageous conditions to the archer without interfering trembling, recoil and other force affecting, aggravating conditions which impair the ability to shoot.

The stabilizer 201 is compact because its length L and width $B^1$ substantially correspond with each other.

Figure 9:
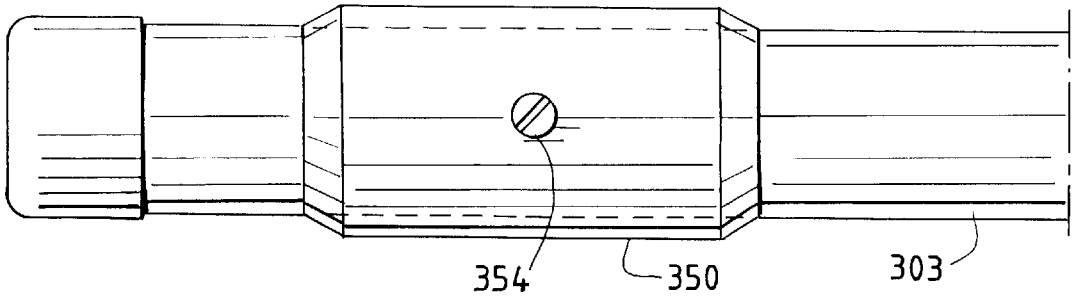
FIG. 9 shows a weight on the housing as seen from the side.
Figure 10:
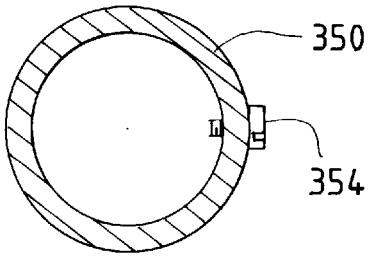
FIG. 10 is a sectional view of the weight.

According to embodiments of the invention which are shown in FIG. 7–10, there is a displaceable weight 350 threaded upon a tubular housing g303. Circular rods 352 of rubber are mounted in cavities 351 running along the entire tube 303. The displaceable weight 350 is arranged outside the circular rods 352 and the tube 303 in order to be adjusted and locked in a desired position of damping, like for example is shown in FIG. 9. For example, a locking screw 354 may function as locking means for the weight 350 to the tube 303 or some other suitable prior art locking means may be used for this purpose.

The benefits by this type of tube and the adjustable weight is among others to obtain a better stability in the tube by using this profile. In doing so occurring vibrations may be received and absorbed as well as allowing them to be conducted away. The displaceable weight 350 enables each archer to individually adapt where along the stabilizer the balance is desired to be positioned.

The advantage with this is that you have a large flexibility for adjusting the position of balance exactly where it is desired. Partly for finding the right balance of the archery bow, and also to find the right position where the archery bow is optimal for grouping the arrows. The stabilizer according to the invention has been tested in secrecy and the results have turned out very favorable. Both vibrations longitudinally as well as in angle against it are absorbed efficiently by said stabilizer.

The invention is not limited to the embodiments described and shown in the application, but may be varied within the scope of the patent claims without departing from the inventive concept.

What is claimed is:

1. A stabilizer for a weapon, comprising:

a housing having an interior;

a coupling attached to an end of said housing in order to enable said housing to releasably connect to a weapon;

a material received in the interior of said housing, wherein said material consists of inertia elastic polyurethane foam plastic with open cells;

damping bodies contained in and attached to said foam plastic material, wherein said damping bodies have a larger density than said foam plastic.

2. The stabilizer according to claim 1 wherein said foam plastic material includes a central cavity extending along a longitudinal length of said material, said damping bodies are received in said central cavity and spaced a distance A from each other along the longitudinal length of said material.

3. The stabilizer according to claim 1 wherein said foam plastic material further includes a through hole and said damping bodies are attached by glue to said through hole.

4. The stabilizer according to claim 3 wherein said foam plastic material is tubular, has an envelope surface, and includes a cutting along said longitudinal length through said envelope surface, whereby facilitating the attachment of said damping bodies to said foam plastic material.

5. The stabilizer according to claim 4 further comprising a material of inertia elastic polyurethane foam plastic with open cells positioned between said damping bodies.

6. The stabilizer according to claim 1 further comprising a plurality of foam plastic materials received in the interior of said housing, each said foam plastic material includes damping bodies contained within.

7. The stabilizer according to claim 1 wherein said foam plastic material has a density of approximately 85 $Kg/m^3$.

8. The stabilizer according to claim 1 wherein said housing is tubular and formed from one of a metal, aluminum, plastic, glass or fibre material.

9. The stabilizer according to claim 1 further comprising at least one gable in the shape of a sleeve connected to said housing, said gable is manufactured from metal, and said at least one gable comprises said coupling for attachment of said housing to said weapon.

10. The stabilizer according to claim 1 wherein said foam plastic material is connected to said interior of said housing by an adhesive.

11. A stabilizer for a weapon, comprising;

a housing having an interior;

a coupling attached to an end of said housing in order to enable said housing to releasably connect to a weapon;

a plurality of foam plastic bodies received in the interior of said housing, wherein said foam plastic bodies consists of an inertia elastic polyurethane foam plastic with open cells;

damper bodies received in a common layer along a common plane between said foam plastic bodies, wherein said damper bodies are attached to said foam plastic bodies and have a larger density than said foam plastic bodies.

12. The stabilizer according to claim 11 further comprising several layers of damper bodies and foam plastic bodies.

13. The stabilizer according to claim 12 wherein said foam plastic bodies are disc shaped and said damper bodies are distributed along and attached to opposing surfaces of said conjugate disc shaped foam plastic bodies.

14. The stabilizer according to claim 13 further comprising pre-formed holes in said foam plastic bodies and said damper bodies are attached to said pre-formed holes by an adhesive.

15. The stabilizer according to claim 11 wherein said damper bodies are evenly distributed along a circumference of said foam plastic bodies and are also contained within the spaces between said foam plastic bodies.

16. The stabilizer according to claim 11 wherein said foam plastic bodies consist of material having a density of approximately 85 $Kg/m^3$.

17. The stabilizer according to claim 11 wherein said housing is tubular and manufactured from one of a metal, aluminum, plastic, glass or fibre material.

18. The stabilizer according to claim 11 further comprising at least one gable in the shape of a sleeve connected to said housing, said gable is manufactured from metal and said at least one gable comprises said coupling for attachment of said housing to said weapon.

19. The stabilizer according to claim 11 wherein said foam plastic bodies are connected to said housing by an adhesive.

20. The stabilizer according to claim 11 wherein said stabilizer is compact, having a length and breadth that are approximately equal.

21. The stabilizer according to claim 11 wherein said housing includes at least one recess extending along a length of said housing, and further comprising at least one round, rubber section rod within said recess, and a displaceable weight arranged on an outside of said rod, wherein said weight is adjustably locked into any desired damping position along said housing.

* * * * *